US012577493B2

(12) United States Patent
Gao et al.

(10) Patent No.: US 12,577,493 B2
(45) Date of Patent: Mar. 17, 2026

(54) BIO-BASED LUBRICANT COMPOSITIONS

(71) Applicant: ExxonMobil Technology and Engineering Company, Spring, TX (US)

(72) Inventors: Zhisheng Gao, Flemington, NJ (US); Nicholas W. Mcbride, Morristown, NJ (US); Jose A. Gomez, Houston, TX (US); Benjamin D. Eirich, Frenchtown, NJ (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 0 days.

(21) Appl. No.: 18/679,205

(22) Filed: May 30, 2024

(65) Prior Publication Data

US 2024/0409840 A1 Dec. 12, 2024

Related U.S. Application Data

(60) Provisional application No. 63/507,251, filed on Jun. 9, 2023.

(51) Int. Cl.
*C10M 169/04* (2006.01)
*C10M 105/04* (2006.01)
(Continued)

(52) U.S. Cl.
CPC ..... *C10M 169/04* (2013.01); *C10M 105/04* (2013.01); *C10M 105/06* (2013.01); *C10M 129/50* (2013.01); *C10M 129/74* (2013.01); *C10M 133/12* (2013.01); *C10M 135/10* (2013.01); *C10M 141/08* (2013.01); *C10M 2203/022* (2013.01); *C10M 2203/065* (2013.01); *C10M 2207/141* (2013.01);
(Continued)

(58) Field of Classification Search
CPC ..... C10M 169/04; C10M 105/04; C10M 105/06; C10M 129/50; C10M 129/74; C10M 133/12; C10M 135/10; C10M 141/08; C10M 2203/022; C10M 2203/065; C10M 2207/141; C10M 2207/283; C10M 2215/26; C10M 2219/044; C10N 2030/04
See application file for complete search history.

(56) References Cited

U.S. PATENT DOCUMENTS 2,100,993 A 11/1937 Bruson
3,036,003 A 5/1962 Arthur
(Continued)

FOREIGN PATENT DOCUMENTS

CA 1094044 A 1/1981
EP 471071 A1 2/1992
EP 1994125 B1 * 10/2012 ..... C10M 163/00

*Primary Examiner* — Ellen M Mcavoy
(74) *Attorney, Agent, or Firm* — Vorys, Sater, Seymour and Pease LLP

(57) ABSTRACT

A lubricant composition may be used as an engine oil. Such lubricant compositions may, for example, include: from about 25.0 mass % to about 99.8 mass % of an oil base stock, based on a total mass of the lubricant composition, the oil base stock including at least one bio-sourced basestock and at least one alkyl naphthalene; and wherein the lubricant composition includes about 0.05 mass % or less phosphorus, about 0.05 mass % or less sulfur, and about 0.5 mass % or less ash.

23 Claims, 1 Drawing Sheet

(51) Int. Cl.

| | |
|---|---|
| ***C10M 105/06*** | (2006.01) |
| ***C10M 129/50*** | (2006.01) |
| ***C10M 129/74*** | (2006.01) |
| ***C10M 133/12*** | (2006.01) |
| ***C10M 135/10*** | (2006.01) |
| ***C10M 141/08*** | (2006.01) |
| *C10N 30/00* | (2006.01) |
| *C10N 30/04* | (2006.01) |
| *C10N 30/06* | (2006.01) |
| *C10N 30/10* | (2006.01) |
| *C10N 40/25* | (2006.01) |

(52) U.S. Cl.

CPC ... *C10M 2207/283* (2013.01); *C10M 2215/26* (2013.01); *C10M 2219/044* (2013.01); *C10N 2030/04* (2013.01); *C10N 2030/06* (2013.01); *C10N 2030/10* (2013.01); *C10N 2030/42* (2020.05); *C10N 2030/43* (2020.05); *C10N 2030/45* (2020.05); *C10N 2040/25* (2013.01)

(56) References Cited

U.S. PATENT DOCUMENTS

| | | | |
|---|---|---|---|
| 3,087,936 | A | 4/1963 | Le Suer |
| 3,172,892 | A | 3/1965 | Le Suer et al. |
| 3,200,107 | A | 8/1965 | Le Suer |
| 3,215,707 | A | 11/1965 | Rense et al. |
| 3,219,666 | A | 11/1965 | Norman et al. |
| 3,254,025 | A | 5/1966 | Le Suer |
| 3,272,746 | A | 9/1966 | Le Suer et al. |
| 3,275,554 | A | 9/1966 | Hendrik |
| 3,316,177 | A | 4/1967 | Dorer, Jr. et al. |
| 3,322,670 | A | 5/1967 | Burt et al. |
| 3,329,658 | A | 7/1967 | Fields et al. |
| 3,341,542 | A | 9/1967 | Le Suer et al. |
| 3,413,347 | A | 11/1968 | Worrel |
| 3,438,757 | A | 4/1969 | Honnen et al. |
| 3,444,170 | A | 5/1969 | Norman et al. |
| 3,449,250 | A | 6/1969 | Fields |
| 3,454,555 | A | 7/1969 | G.P. Van Der Voort et al. |
| 3,454,607 | A | 7/1969 | Le Suer et al. |
| 3,519,565 | A | 7/1970 | Coleman et al. |
| 3,541,012 | A | 11/1970 | Stuebe |
| 3,565,804 | A | 2/1971 | Honnen et al. |
| 3,630,904 | A | 12/1971 | Musser et al. |
| 3,632,511 | A | 1/1972 | Liao |
| 3,652,616 | A | 3/1972 | Watson et al. |
| 3,666,730 | A | 5/1972 | Coleman |
| 3,687,849 | A | 8/1972 | Abbott |
| 3,697,574 | A | 10/1972 | Piasek et al. |
| 3,702,300 | A | 11/1972 | Coleman et al. |
| 3,703,536 | A | 11/1972 | Piasek et al. |
| 3,704,308 | A | 11/1972 | Piasek et al. |
| 3,725,277 | A | 4/1973 | Worrel |
| 3,725,480 | A | 4/1973 | Traise et al. |
| 3,726,882 | A | 4/1973 | Traise et al. |
| 3,751,365 | A | 8/1973 | Piasek et al. |
| 3,755,433 | A | 8/1973 | Miller et al. |
| 3,756,953 | A | 9/1973 | Piasek et al. |
| 3,787,374 | A | 1/1974 | Adams |
| 3,798,165 | A | 3/1974 | Piasek |
| 3,803,039 | A | 4/1974 | Piasek et al. |
| 3,822,209 | A | 7/1974 | Knapp et al. |
| 3,948,800 | A | 4/1976 | Meinhardt |
| 4,100,082 | A | 7/1978 | Clason et al. |
| 4,234,435 | A | 11/1980 | Meinhardt et al. |
| 4,426,305 | A | 1/1984 | Malec |
| 4,454,059 | A | 6/1984 | Pindar et al. |
| 4,652,416 | A | 3/1987 | Millot |
| 4,767,551 | A | 8/1988 | Hunt et al. |
| 4,956,122 | A | 9/1990 | Watts et al. |
| 5,084,197 | A | 1/1992 | Galic et al. |
| 5,705,458 | A | 1/1998 | Roby |
| 6,323,164 | B1 | 11/2001 | Liesen et al. |
| 7,704,930 | B2 | 4/2010 | Deckman et al. |
| 8,247,358 | B2 | 8/2012 | Lee et al. |
| 8,492,321 | B2 | 7/2013 | Goujon |
| 11,345,872 | B2 | 5/2022 | Gao |
| 2006/0052254 | A1* | 3/2006 | Shaw ..... C10M 163/00 508/287 |
| 2006/0058200 | A1* | 3/2006 | Shaw ..... C10M 169/04 508/192 |
| 2008/0300157 | A1* | 12/2008 | Wu ..... C10M 111/06 508/591 |
| 2019/0062667 | A1* | 2/2019 | Gao ..... C10M 135/06 |
| 2019/0062668 | A1* | 2/2019 | Gao ..... C10M 161/00 |
| 2019/0127658 | A1* | 5/2019 | Pelligra ..... C10M 135/10 |
| 2021/0238493 | A1* | 8/2021 | Gao ..... C10M 133/12 |

* cited by examiner

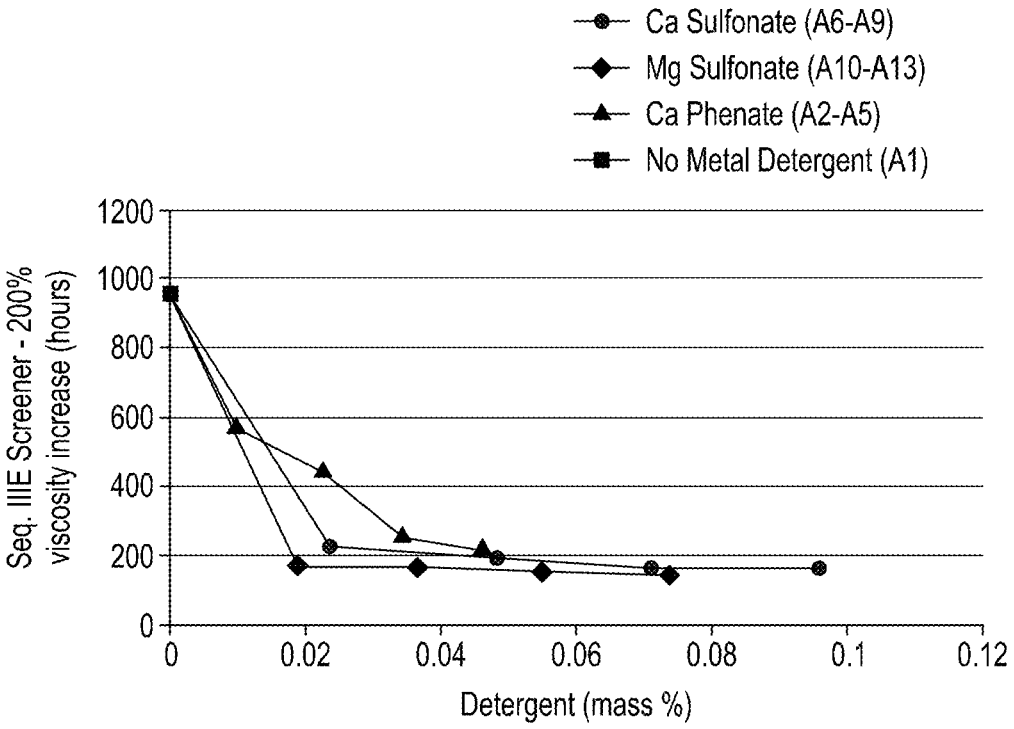
Ca Sulfonate (A6-A9)
Mg Sulfonate (A10-A13)
Ca Phenate (A2-A5)
No Metal Detergent (A1)
Seq. IIIE Screener - 200% viscosity increase (hours)
1200
1000
800
600
400
200
0
0
0.02
0.04
0.06
0.08
0.1
0.12
Detergent (mass %)

BIO-BASED LUBRICANT COMPOSITIONS

FIELD

This application generally relates to lubricant compositions and processes for making the same. More particularly, this application relates to low-sulfur, low-ash, and low-phosphorus-containing engine lubricant compositions and processes for making the same.

BACKGROUND

Conventional engine lubricants generally contain, among other things, an oil base stock, at least one antiwear additive to reduce friction between engine parts, at least one detergent to help maintain engine cleanliness, at least one dispersant to suspend contaminants in the oil, and at least one antioxidant. Phosphorus-containing and sulfur-containing compounds are commonly used as antiwear additives in engine lubricants. Examples of such antiwear additives are zinc dialkyldithiophosphates (ZDDP). Detergents that are typically used in engine lubricants include calcium sulfonates, calcium salicylates, and magnesium sulfonates. Over time such antiwear additives and detergents can lead to the formation of an ash residue.

The sulfur, phosphorus, and ash present in conventional engine lubricants can adversely affect engine post-treatment devices and the catalyst used in such devices. For example, the presence of ash can impact particulate filters that are used in gasoline engines to meet emission requirements. The ash accumulated in the gasoline particulate filter can increase engine back pressure, leading to poorer fuel economy.

Another problem associated with conventional engine lubricants is the oxidation of the lubricants at high temperatures, including temperatures of current internal combustion engine technology, which may be above 200° C. for some engine parts.

SUMMARY

A first nonlimiting composition of the present disclosure, the composition being a lubricant composition for use as an engine oil, includes: from about 25.0 mass % to about 99.8 mass % of an oil base stock, based on a total mass of the lubricant composition, the oil base stock comprising at least one bio-sourced basestock and at least one alkyl naphthalene; and wherein the lubricant composition comprises about 0.05 mass % or less phosphorus, about 0.05 mass % or less sulfur, and about 0.05 mass % or less ash.

A second nonlimiting composition of the present disclosure, the composition being a lubricant composition for use as an engine oil, includes: from about 25.0 mass % to about 99.8 mass % of an oil base stock, based on a total mass of the lubricant composition, the oil base stock comprising at least one bio-sourced basestock and at least one alkyl naphthalene, wherein the lubricant composition comprises from about 40.0 mass % to about 80.0 mass % of the at least one bio-sourced basestock, and wherein the lubricant composition comprises about 10.0 mass % to 30.0 mass % of the at least one alkyl naphthalene; from about 0.0 mass % to about 1.0 mass % of at least one metal detergent, based on the total mass of the lubricant composition; from about 0.1 mass % to about 1.0 mass % of the at least one ashless antiwear additive; from about 0.1 mass % to about 10.0 mass % of the at least one antioxidant; wherein the lubricant composition comprises about 0.05 mass % or less phosphorus, about 0.05 mass % or less sulfur, and about 0.5 mass % or less ash.

A nonlimiting process of the present disclosure, the process being a process for making a lubricant composition, includes: combining from about 25.0 mass % to about 99.8 mass % of an oil base stock, based on a total mass of the lubricant composition, the oil base stock comprising at least one bio-sourced basestock and at least one alkyl naphthalene, and from about 0.0 mass % to about 1.0 mass % of at least one metal detergent, based on the total mass of the lubricant composition; wherein the lubricant composition comprises about 0.05 mass % or less phosphorus, about 0.05 mass % or less sulfur, and about 0.5 mass % or less ash.

These and other features and attributes of the disclosed compositions and methods of the present disclosure and their advantageous applications and/or uses will be apparent from the detailed description which follows.

BRIEF DESCRIPTION OF THE DRAWINGS

To assist those of ordinary skill in the relevant art in making and using the subject matter hereof, reference is made to the appended drawing(s). The following FIGURE(s) are included to illustrate certain aspects of the disclosure, and should not be viewed as exclusive configurations. The subject matter disclosed is capable of considerable modifications, alterations, combinations, and equivalents in form and function, as will occur to those skilled in the art and having the benefit of this disclosure.

The FIGURE shows a graph of hours to 200% viscosity increase (Seq. III Screener) for compositions of the present disclosure.

DETAILED DESCRIPTION

This application generally relates to lubricant compositions and processes for making the same. More particularly, this application relates to low-sulfur, low-ash, and low-phosphorus containing engine lubricant compositions and processes for making the same.

The term "mass %" as used herein indicates percentage by mass such as percentage by weight, "vol %" as used herein indicates percentage by volume, "mol %" as used herein indicates percentage by mole, "ppm" as used herein indicates parts per million, and "ppm wt" and "wppm" are used interchangeably and mean parts per million on a weight basis. All concentrations herein, unless otherwise stated, are expressed on the basis of the total amount of the composition in question.

The term "polymer" as used herein refers to any two or more of the same or different repeating units/mer units or units. The term "homopolymer" as used herein refers to a polymer having units that are the same. The term "copolymer" as used herein refers to a polymer having two or more units that are different from each other and includes terpolymers and the like. The term "terpolymer" as used herein refers to a polymer having three units that are different from each other. The term "different" as used herein as it refers to units indicates that the units differ from each other by at least one atom or are different isomerically. Likewise, the definition of polymer, as used herein, includes homopolymers, copolymers, and the like.

The term "oil base stock" as used herein refers to any base fluid that could be used in a lubricant including, but not limited to, a terpene, a mineral oil, a synthetic hydrocarbon, an ester, the like, or any combination thereof. An oil base stock as used herein may include Group I, II, III, IV, and V (as defined by American Petroleum Institute [API]) base oils, including any combination thereof. The terms "base oil," "oil base stock," and "basestock" are used interchangeably.

The terms "bio-based," "bio-sourced," "bio-derived," "naturally-derived," "renewable," and grammatical variations thereof as used herein refer to compounds containing a bio-based carbon content of 25% or greater as defined by ASTM D6866-22.

The term "alphaolefin" refers to any linear or branched compound of carbon and hydrogen having at least one double bond between the a and R carbon atoms. For purposes of this specification and the claims appended thereto, when a polymer or copolymer is referred to as including an alpha-olefin (e.g., a polyalphaolefin) the alpha-olefin present in such polymer or copolymer is the polymerized form of the alpha-olefin.

Nomenclature of elements and groups thereof used herein are pursuant to the Periodic Table used by the International Union of Pure and Applied Chemistry after 1988. An example of the Periodic Table is shown in the inner page of the front cover of Advanced Inorganic Chemistry 6th Edition, by F. Albert Cotton et al. (John Wiley & Sons, Inc., 1999).

The present disclosure includes compositions and methods of making thereof including lubricant compositions comprising low-sulfur, low-ash, and low-phosphorous (low-SAP). The compositions of the present disclosure may be used as an engine oil, for example in internal combustion applications. A trend in engine design and operation has been to decrease sizes of engines in order to reduce fuel consumption and tailpipe emissions. As a result, energy density of engines has tended to increase. With increased energy density, higher internal temperatures may result. As internal temperatures of modern engines have increased (e.g., to 200° C. or greater for some parts), oxidation stability of conventional oils cannot be maintained in many instances. The low-SAP lubricant compositions described herein enable higher oxidation stability compared to conventional lubricants. Thus, the lubricant compositions of the present disclosure may have a 200% viscosity increase time at 165° C. from about 200 hours to about 1,600 hours (about 400 hours to about 1,500 hours, or about 500 hours to about 1,000 hours, or about 400 hours to about 1,000 hours, or about 200 hours or greater, or about 400 hours or greater, or about 500 hours or greater), as measured by the Sequence IIIE screener test. Additionally, the use of low-SAP engine oil minimizes the adverse effects the oil could otherwise have on post-treatment devices such as particulate filters and catalysts associated therewith. Accordingly, the longevity of post-treatment devices can be improved by using the lubricant compositions disclosed herein.

Additionally, lubricant compositions of the present disclosure may comprise one or more bio-sourced basestocks. Bio-sourced basestocks may provide reduced lifecycle emissions for a lubricant as such basestocks may have a significant portion derived from biological sources, enabling reduction in use of conventional petroleum-derived basestocks. Bio-sourced basestocks may also enable fewer emissions when lubricants are disposed of at the end of the lubricant lifespan. Furthermore, bio-sourced basestocks may originate from renewable sources (e.g., sugarcane, corn, the like, or any combination thereof), enabling renewable production and use. Due to the use of one or more bio-sourced basestocks, lubricant compositions of the present disclosure may have a bio-based carbon content (as measured by ASTM D6866-22) of about 25% or greater (or about 50% or greater, or about 60% or greater, or about 70% or greater, or about 80% or greater, or about 90% or greater, or about 95% or greater).

Lubricant Compositions

Low-sulfur, low-ash, low-phosphate (low-SAP) lubricant compositions of the present disclosure may include from about 25.0 mass % to about 99.8 mass % (or preferably about 60.0 mass % to about 95.0 mass %, or more preferably about 80.0 mass % to about 90.0 mass %), of an oil base stock comprising at least one bio-sourced basestock and at least one alkyl naphthalene. The lubricant compositions may, optionally, include at least one metal detergent. The lubricant compositions also may include at least one ashless antiwear additive and at least one antioxidant. The lubricant compositions may also include at least one dispersant.

The term "low-sulfur" as used herein indicates that a lubricant composition has less than about 0.05 mass % (or preferably less than about 0.03 mass %, or more preferably less than about 0.01 mass %, of sulfur). The term "low-ash" as used herein indicates that the lubricant composition has less than 0.5 mass % (or preferably less than about 0.05 mass %, or preferably less than about 0.03 mass %, or more preferably less than about 0.01 mass %) of ash, wherein the ash may comprise, for example, metal material. "Metal material" as used herein refers to metals in the lubricant composition, including, but not limited to, calcium, magnesium, sodium, the like, or any combination thereof. The term "low-phosphorus" as used herein indicates that the lubricant composition less than about 0.05 mass % (or preferably less than about 0.03 mass %, or more preferably less than about 0.01 mass %), of phosphorus. All of the foregoing mass percentages are based on the total mass of the lubricant composition.

Oil Base Stock

The oil base stock components used herein may include any of the well-known American Petroleum Institute (API) categories of Group I through Group V, including combinations thereof. The API defines Group I stocks as solvent-refined mineral oils. Group I stocks contain the least saturates and highest amount of sulfur and generally have the lowest viscosity indices. Group II and III stocks are high viscosity index and very high viscosity index base stocks, respectively. The Group III oils generally contain fewer unsaturates and sulfur than the Group II oils.

Group IV stocks consist of polyalphaolefins, which are produced via the catalytic oligomerization of linear alphaolefins (LAOs), particularly LAOs selected from C5-C14 alphaolefins, including, but not limited to, from 1-hexene to 1-tetradecene, 1-octene to 1-dodecene, and mixtures thereof, with 1-decene being the preferred material, although oligomers of lower olefins such as ethylene and propylene, oligomers of ethylene/butene-1 and isobutylene/butene-1, and oligomers of ethylene with other higher olefins, as described in U.S. Pat. No. and the patents referred to therein, and the like, or any combinations thereof may also be used. Additional further description of suitable polyalphaolefins may be found in U.S. Pat. No. 11,345,872.

Group V includes all the other base stocks not included in Groups I through IV. Group V base stocks include lubricants based on or derived from esters. Group V additionally includes alkylated aromatics, polyalkylene glycols (PAGs), alkylated naphthalene, the like, or any combination thereof.

The oil base stock used herein may preferably include, but is not limited to, a polyalphaolefin, a squalane, an ester (e.g., a polyol ester, a pentacrythritol ester, the like, or any combination thereof), an alkyl naphthalene, or any combination thereof. Any one of the oil base stock components may preferably be a bio-sourced base stock (e.g., a bio-sourced hydrocarbon, a hydro-processed or severely hydro-processed bio-sourced basestock, a bio-sourced basestock from the wax isomerization process, a co-processed of bio-sourced basestock, a bio-sourced ester, a bio-sourced polyalphaolefin, the like, or any combination thereof). The bio-sourced basestock may have a bio-based carbon content (as measured by ASTM D6866-22) of about 25% or greater (or about 50% or greater, or about 60% or greater, or about 70% or greater, or about 80% or greater, or about 90% or greater, or about 95% or greater, or about 99% or greater, or about 99.9% or greater, or about 100%, or 100%). Oil base stock used herein may also preferably include, but is not limited to, a hydrocarbon and an ester from advanced sustainable sources (e.g., municipal solid waste, forestry waste, pulp and paper waste, plastic and tire waste, food, sugar, or wine process waste, as well as those obtained through carbon capture and water electrolysis with renewable energy).

The oil base stock may preferably include at least one alkyl naphthalene and at least one bio-sourced basestock. As a nonlimiting example, an oil base stock may include a bio-sourced alkyl naphthalene, the bio-sourced alkyl naphthalene counting as both the at least one alkyl naphthalene and as the at least one bio-sourced basestock. As another nonlimiting example, an oil base stock may include a non-naphthalene bio-sourced basestock and an alkyl naphthalenc. The lubricant compositions may comprise from about 40.0 mass % to about 80.0 mass % (or about 50 mass % to about 70 mass %, or about 55 mass % to about 65 mass %, or about 60 mass % to about 70 mass %) of the at least one bio-sourced basestock, by total mass of the lubricant composition. The lubricant compositions may comprise from about 10.0 mass % to about 50.0 mass % (or about 10.0 mass % to about 30.0 mass %, or about 15 mass % to about 25 mass %, or about 10 mass % to about 20 mass %, or about 20 mass % to about 30 mass %, or about 15 mass % to about 30 mass %) of the at least one alkyl naphthalene, by total mass of the lubricant composition.

A suitable oil base stock may preferably comprise a squalane. Suitable squalane may include, but is not limited to, sugarcane-derived squalane (e.g., NEOSSANCE® squalane, available from Aprinnova).

The alkylated naphthalene present in the oil base stock can be any hydrocarbyl molecule that contains at least about 5% of its mass derived from a naphthenoid moiety or its derivatives. The naphthenoid group can be mono-alkylated, dialkylated, polyalkylated, and the like. The naphthenoid group can be mono- or poly-functionalized. The naphthenoid group can also be derived from natural (petroleum) sources, provided at least about 5% of the molecule is comprised of the naphthenoid moiety. Viscosities at 100° C. of approximately 3 cSt to about 50 cSt are preferred, with viscosities of approximately 3.4 cSt to about 20 cSt often being more preferred for the naphthalene component. Naphthalene or methyl naphthalene, for example, may be alkylated with olefins such as octene, decene, dodecene, tetradecene or higher, mixtures of similar olefins, and the like.

Alkylated naphthalenes can be produced by well-known Friedel-Crafts alkylation of aromatic compounds. See Friedel-Crafts and Related Reactions, Olah, G. A. (ed.), Interscience Publishers, New York, 1963. For example, an aromatic compound, such as naphthalene, is alkylated by an olefin, alkyl halide, or alcohol in the presence of a Friedel-Crafts catalyst. Sec Friedel-Crafts and Related Reactions, Vol. 2, part 1, chapters 14, 17, and 18, See Olah, G. A. (ed.), Inter-science Publishers, New York, 1964. Many homogeneous or heterogeneous solid catalysts are known in the art. The choice of catalyst depends on the reactivity of the starting materials and product quality requirements. For example, strong acids such as $AlCl_3$, $BF_3$, or HF may be used. In some cases, milder catalysts such as $FeCl_3$ or $SnCl_4$ are preferred. Newer alkylation technology may use zeolites, solid super acids, or combinations thereof.

As another nonlimiting example, the lubricant compositions may comprise from about 5.0 mass % to about 15.0 mass % (or about 5.0 mass % to about 9.0 mass %, or about 5.0 mass % to about 7.0 mass %) of at least one polyol ester, based on the total mass of the lubricant composition.

As further nonlimiting example, the lubricant compositions may comprise from about 5.0 mass % to about 15.0 mass % (or about 10 mass % to about 30 mass %, or about 5.0 mass % to about 9.0 mass %, or about 5.0 mass % to about 7.0 mass %) of at least one pentaerythritol ester (e.g., mixed pentaerythritol esters of branched alkanoic acids) or a trimethylolpropane ester (e.g., trimethylolpropane 3,5,5-trimethylhexanoate ester), based on the total mass of the lubricant composition.

Metal Detergent

The optional metal detergent may, if included, serve to maintain engine cleanliness and to inhibit contaminants from being deposited on engine parts. The metal detergent, if present, may be included in the lubricant compositions at a concentration from about 0.0 mass % to about 1.0 mass % (or about 0.0 mass % to about 0.8 mass %, or about 0.0 mass % to about 0.6 mass %, or about 0.0 mass % to about 0.4 mass %, or about 0.0 mass % to about 0.2 mass %, or about 0.001 mass % to about 1.0 mass %, or about 0.001 mass % to about 0.8 mass %, or about 0.001 mass % to about 0.6 mass %, or about 0.001 mass % to about 0.4 mass %, or about 0.001 mass % to about 0.2 mass %, or about 0.1 mass % to about 0.8 mass %, or about 0.1 mass % to about 0.4 mass %, or about 0.1 mass % to about 0.2 mass %, or about 1.0 mass % or less, or about 0.5 mass % or less, or about 0.2 mass % or less), based on the total mass of the lubricant composition. The optional metal detergent may comprise at least one metal detergent (e.g., at least two metal detergents).

The metal detergent may include, but is not limited to, a metal sulfonate detergent, a metal phenate detergent, a salicylate detergent, the like, or any combination thereof. The metal detergent may include calcium sulfonate, magnesium sulfonate, or a combination thereof. The metal detergent may preferably include calcium phenate. The metal detergent may comprise an overbased metal detergent. As used herein, "overbased" refers to compositions containing a stoichiometric excess of a metal base salt (cation) in relation to the anion of the metal base salt.

Without being bound by theory, overbased detergent may allow for neutralizing of any acid impurities that may enter the lubricant composition during use in an engine. Thus, at suitable concentrations in the lubricant compositions of the present disclosure, the herein described metal detergents may allow for increased oxidation stability while maintaining suitable engine cleanliness and deposit inhibition.

Examples of suitable metal detergents include, but are not limited to, INFINEUM® C9330 and INFINEUM® C9340, Infineum M7101, Infineum M7102, Infineum M7105, Infincum M7121, Infineum M7125, (available from INFINEIUM International), Oloa 216M, OLOA® 218A, Oloa 219M (available from Chevron Oronite), the like, or any combination thereof.

Nonionic Detergent

A nonionic detergent may supplement the metal detergent. The nonionic detergent may be included in the lubricant compositions at a concentration from about 0.0 mass % to about 1.0 mass % (or about 0.0 mass % to about 0.8 mass %, or about 0.0 mass % to about 0.6 mass %, or about 0.0 mass % to about 0.4 mass %, or about 0.0 mass % to about 0.2 mass %, or about 0.001 mass % to about 1.0 mass %, or about 0.001 mass % to about 0.8 mass %, or about 0.001 mass % to about 0.6 mass %, or about 0.001 mass % to about 0.4 mass %, or about 0.001 mass % to about 0.2 mass %, or about 0.1 mass % to about 0.8 mass %, or about 0.1 mass % to about 0.4 mass %, or about 0.1 mass % to about 0.2 mass %), based on the total mass of the lubricant composition.

Suitable nonionic detergents include, but are not limited to, polyoxyethylene, polyoxypropylene, polyoxybutylene alkyl ethers, the like, or any combination thereof. For reference, see "Nonionic Surfactants: Physical Chemistry" Martin J. Schick, CRC Press 2nd edition (Mar. 27, 1987). These nonionic detergents may offer increased solubility in base oils including, but not limited to, ester base oils, alkylated naphthalene, squalane, the like, or any combination thereof.

The most preferred nonionic detergents may be ashless nonionic detergents with a Hydrophilic-Lipophilic Balance (HLB) value of 10 or below. Examples of such detergents include, but are not limited to, ALARMOL™ PS11E and ALARMOL™ PS15E (available from Croda), as well as ECOSURF™ EH-3, TERGITOL™ 15-S-3, TERGITOL™ L-61, TERGITOL™ L-62, TERGITOL™ NP-4, TERGITOL™ NP-6, TERGITOL™ NP-7, TERGITOL™ NP-8, TERGITOL™ NP-9, TRITON™ X-15, and TRITON™ X-35 (all available from Dow Chemical).

Ashless Antiwear Additive

An ashless antiwear additive can serve to reduce wear between engine parts. The ashless antiwear additive may be included in the lubricant composition at concentrations, by total mass of the lubricant composition, from about 0.01 mass % to about 1.0 mass % (or about 0.01 mass % to about 0.8 mass %, or about 0.1 mass % to about 1.0 mass %, or about 0.1 mass % to about 0.5 mass %).

The ashless antiwear additive can be or can include an amine phosphate, an over-neutralized amine phosphate, or combinations thereof. The amine phosphate can be prepared by reacting an amine compound or a polyamine compound with a phosphoric acid. Suitable amines are disclosed in U.S. Pat. No. 4,234,435, the relevant portions thereof being incorporated by reference herein. An "over-neutralized" amine phosphate is preferred, meaning that a more than sufficient amount of amine is added to neutralize an acid phosphate, and this neutralization can be done with one or more amines.

The phosphorus compounds disclosed herein can be prepared by well known reactions. For example, they can be prepared by the reaction of an alcohol or a phenol with phosphorus trichloride or by a transesterification reaction. C6 to C12 alcohols and alkyl phenols can be reacted with phosphorus pentoxide to provide a mixture of an alkyl or aryl phosphoric acid and a dialkyl or diaryl phosphoric acid. Alkyl phosphates can also be prepared by the oxidation of the corresponding phosphites. In any case, the reaction can be conducted with moderate heating. Moreover, various phosphorus esters can be prepared by reaction using other phosphorus esters as starting materials. Thus, medium chain (C6 to C22) phosphorus esters can be prepared by reaction of dimethylphosphite with a mixture of medium-chain alcohols by means of a thermal transesterification or an acid- or base-catalyzed transesterification; see for example U.S. Pat. No. 4,652,416. Such materials are also commercially available: for instance, triphenyl phosphite is available from Albright and Wilson as DURAPHOS TPP™; di-n-butyl hydrogen phosphite is available from Albright and Wilson as DURAPHOS DBHP™; and triphenylthiophosphate is available from BASF as IRGALUBE TPPT™.

An alkyl or aryl phosphoric acid and a dialkyl or diaryl phosphoric acid, or their mixtures, can be neutralized by one or more amines. Amines that can form amine salts with such phosphoric acids include, for example, mono-substituted amines, di-substituted amines and tri-substituted amines. Examples of mono-substituted amines include butylamine, pentylamine, hexylamine, cyclohexylamine, octylamine, laurylamine, stearylamine, oleylamine and benzylamine. Examples of di-substituted amines include dibutylamine, dipentylamine, dihexylamine, dicyclohexylamine, dioctylamine, dilaurylamine, ditridecylamine, distearylamine, dioleylamine, dibenzylamine, stearyl monoethanolamine, decyl monocthanolamine, hexyl monopropanolamine, benzyl monocthanolamine, phenyl monoethanolamine, and tolyl monopropanolamine. Examples of tri-substituted amines include tibutylamine, tripentylamine, trihexylamine, tricyclohexylamine, trioctylamine, trilaurylamine, tristearylamine, trioleylamine, tribenzylamine, diolcyl monoethanolamine, dilauryl monopropanolamine, dioctyl monocthanolamine, dihexyl monopropanolamine, dibutyl monopropanolamine, oleyl diethanolamine, stearyl dipropanolamine, lauryl diethanolamine, octyl dipropanolamine, butyl diethanolamine, benzyl diethanolamine, phenyl dicthanolamine, tolyl dipropanolamine, xylyl diethanolamine, triethanolamine, and tripropanolamine.

Polyamines that can form salts with the phosphoric acids provided herein include, but are not limited to, for example, alkoxylated diamines, fatty polyamine diamines, alkylenepolyamines, hydroxy containing polyamines, condensed polyamines arylpolyamines, and heterocyclic polyamines. Examples of fatty diamines include, but are not limited to, mono- or dialkyl, symmetrical or asymmetrical ethylene diamines, propane diamines (1,2, or 1,3), and polyamine analogs of the above. Suitable commercial fatty polyamines include, but are not limited to, DUOMEEN® C. (N-coco-1,3-diaminopropane), DUOMEEN® S (N-soya-1,3-diaminopropanc), DUOMEEN® T (N-tallow-1,3-diaminopropane), and DUOMEEN® O (N-oleyl-1,3-diaminopropane). "DUOMEEN"® chemicals are commercially available from Nouryon.

Examples of alkylenepolyamines include, but are not limited to, methylenepolyamines, ethylenepolyamines, butylenepolyamines, propylenepolyamines, pentylenepolyamines, the like, or any combination thereof. The higher homologs and related heterocyclic amines such as piperazines and N-amino alkyl-substituted piperazines are also included. Specific examples of such polyamines include, but are not limited to ethylenediamine, triethylenetetramine, tris-(2-aminoethyl)amine, propylenediamine, trimethylenediamine, tripropylenetetramine, tetracthylenepentamine, hexaethylencheptamine, pentaethylenchexamine, the like, or any combination thereof. Higher homologs obtained by condensing two or more of the above-noted alkyleneamines are similarly useful as are mixtures of two or more of the aforedescribed polyamines. Ethylenepolyamine arc described in detail under the heading Ethylene Amines in Kirk Othmer's "Encyclopedia of Chemical Technology", 2d Edition, Vol. 7, pages 22-37, Interscience Publishers, New York (1965). Ethylenepolyamines are often a complex mixture of polyalkylenepolyamines, including cyclic condensation products.

Other useful types of polyamine mixtures are those resulting from stripping of mixtures of the above-described polyamines to leave, as residue, what is often termed "polyamine bottoms." In general, alkylenepolyamine bottoms can be characterized as having less than 2 mass %, usually less than 1 mass %, of material boiling below about 200° C. A typical sample of such ethylene polyaminc bottoms obtained from the Dow Chemical Company of Freeport, Tex. is designated "E-100." These alkylenepolyamine bottoms include cyclic condensation products such as piperazine and higher analogs of diethylenetriamine, triethylenetetramine, and the like. The alkylenepolyamine bottoms can be reacted solely with the acylating agent or they can be used with other amines, polyamines, or mixtures thereof. Another useful polyamine is a condensation reaction between at least one hydroxy compound with at least one polyamine reactant containing at least one primary or secondary amino group. The hydroxy compounds are preferably polyhydric amines. Polyhydric amines can include, but are not limited to, any of the above-described monoamines reacted with an alkylene oxide (e.g., ethylene oxide, propylene oxide, butylene oxide, the like, or any combination thereof) having from two to about 20 carbon atoms, or from two to about four. Examples of polyhydric amines include, but are not limited to, tri-(hydroxypropyl)amine, tris-(hydroxymethyl)amino methane, 2-amino-2-methyl-1,3-propanediol, N,N,N',N'-tctrakis(2-hydroxypropyl)ethylenediamine, and N,N,N',N'-tetrakis(2-hydroxyethyl) ethylenediamine, preferably tris(hydroxymethyl) aminomethane (THAM). Other heterocyclic amines can also include, but are not limited to, aromatic polycyclic amines. Examples of aromatic polycyclic amines include, but are not limited to, tolytriazole and benzotriazole.

The amines mentioned above can be used as a neutralization agent for the alkyl or aryl phosphoric acid, dialkyl or diaryl phosphoric acid, or their mixtures as well as an over-neutralization agent to obtain an overbased alkyl or aryl phosphate, or a dialkyl or diary phosphate, or their mixtures. The preferred amine phosphate is a dialkylphosphoric acid, first neutralized with a dialkyl amine, and then over-neutralized with a tolytriazole. More preferably, the dialkylphosphoric acid is a dihexylphosporic acid.

The other phosphates that could be used as ashless antiwear include triaryl phosphates, trialkyl phosphates, trialkylaryl phosphates, triarylalkyl phosphates and trialkenyl phosphates. As specific examples of these, referred to are triphenyl phosphate, tricresl phosphate, benzyldiphenyl phosphate, ethyldiphenyl phosphate, tributyl phosphate, ethyldibutyl phosphate, cresyldiphenyl phosphate, dicresylphenyl phosphate, cthylphenyldiphenyl phosphate, diethylphenylphenyl phosphate, propylphenyldiphenyl phosphate, dipropylphenylphenyl phosphate, tricthylphenyl phosphate, tripropylphenyl phosphate, butylphenyldiphenyl phosphate, dibutyphenylphenyl phosphate, tributylphenyl phosphate, trihexyl phosphate, tri(2-cthylhexyl) phosphate, tridecyl phosphate, trilauryl phosphate, trimyristyl phosphate, tripalmityl phosphate, tristearyl phosphate, and triolcyl phosphate.

Antioxidant

An antioxidant can serve to retard the oxidative degradation of the oil base stock. Such degradation could result in deposits on metal surfaces, the presence of sludge, or a viscosity increase in the lubricant composition. The antioxidant can be or can include, but is not limited to, a phenolic antioxidant, an aminic antioxidant, a polyaminic antioxidant, the like, or combinations thereof. The antioxidant may be present in the lubricant compositions at a concentration from about 0.1 mass % to about 10.0 mass % (or about 0.1 mass % to about 8 mass %, or about 0.1 mass % to about 5 mass %, or about 1 mass % to about 5 mass %, or about 2 mass % to about 5 mass %), by total mass of the lubricant composition.

The phenolic antioxidant is typically a hindered phenolic which contains a sterically hindered hydroxyl group, including, but not limited to, those derivatives of dihydroxy aryl compounds in which the hydroxyl groups are in the o- or p-position to each other. Suitable hindered phenols can include, but are not limited to, hindered phenols substituted with $C_{6+}$ alkyl groups and the alkylene coupled derivatives of those hindered phenols such as 2-t-butyl-4-heptyl phenol, 2-t-butyl-4-octyl phenol, 2-t-butyl-4-dodecyl phenol, 2,6-di-t-butyl-4-heptyl phenol, 2,6-di-t-butyl-4-dodecyl phenol, 2-methyl-6-t-butyl-4-heptyl phenol, and 2-methyl-6-t-butyl-4-dodecyl phenol. Other useful hindered mono-phenolic antioxidants can include, but are not limited to, hindered 2,6-di-alkyl-phenolic proprionic ester derivatives. Bis-phenolic antioxidants can also be advantageously used in combination with the hindered phenolic antioxidants. Suitable ortho-coupled phenols can include, but are not limited to: 2,2'-bis(4-heptyl-6-t-butyl-phenol); 2,2'-bis(4-octyl-6-t-butyl-phenol); and 2,2'-bis(4-dodecyl-6-t-butyl-phenol). Suitable para-coupled bisphenols can include: 4,4'-bis(2,6-di-t-butyl phenol); and 4,4'-methylene-bis(2,6-di-t-butyl phenol).

The aminic antioxidant is typically an aromatic amine antioxidant. Suitable amine antioxidants can include alkylated and non-alkylated aromatic amines such as aromatic monoamines of the formula $R^8R^9R^{10}N$, where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$, where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ can include from 1 to 20 carbon atoms and preferably include from 6 to 12 carbon atoms. Preferably, both $R^8$ and $R^9$ are aromatic or substituted aromatic groups, where the aromatic group can be a fused ring aromatic group such as naphthyl.

Suitable aromatic amine antioxidants can have alkyl substituent groups of at least 6 carbon atoms. Examples of aliphatic groups can include hexyl, heptyl, octyl, nonyl, and decyl. Typically, the aliphatic groups do not contain more than 14 carbon atoms. The general types of amine antioxidants useful in the lubricant composition disclosed herein include diphenylamines, phenyl naphthylamines, phenothiazines, imidodibenzyls and diphenyl phenylene diamines. Mixtures of two or more aromatic amines can be used. Particular examples of suitable aromatic amine antioxidants include: p,p'-dioctyldiphenylamine; t-octylphenyl-alpha-naphthylamine; phenyl-alpha-naphthylamine; and p-octylphenyl-alpha-naphthylamine. Polymeric aminic antioxidants derived from these diphenylamines, phenyl naphthylamines, and their mixtures can also be used. The polymeric aminic antioxidants may be available in a concentrate form with active polymeric amines in the 10 mass % to 40 mass %. Such polymeric aminic antioxidant concentrates may include, but are not limited to, Nycoperf AO 337 (available from Nyco S.A.).

Other suitable aminic antioxidants include, but are not limited to, polymeric or oligomeric amines which are the polymerization reaction products of one or more substituted or hydrocarbyl-substituted diphenyl amines, one or more unsubstituted or hydrocarbyl-substituted phenyl naphthyl amines, or both one or more of unsubstituted or hydrocarbyl-substituted diphenylamine with one or more unsubstituted or hydrocarbyl-substituted phenyl naphthylamine. A representative schematic is presented below:

(a)

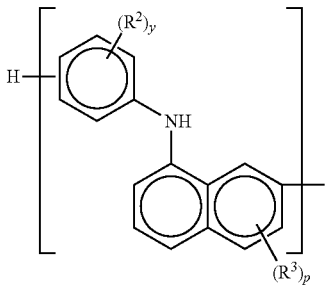

and (b)

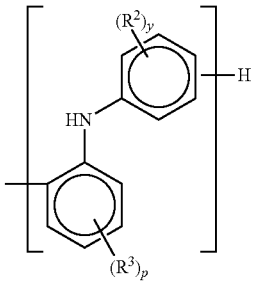

wherein (a) and (b) each range from zero to 10, preferably zero to 5, more preferably zero to 3, most preferably 1 to 3, provided (a)+(b) is at least 2, for example:

(A)

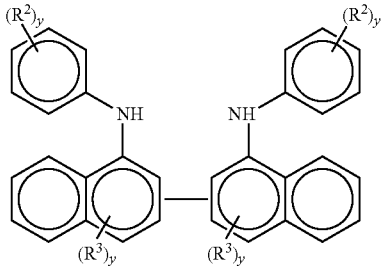

or (B)

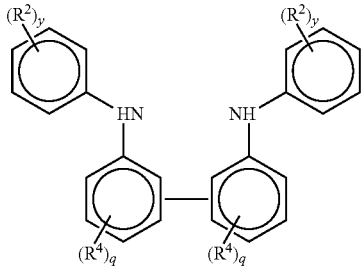

or

-continued (C)

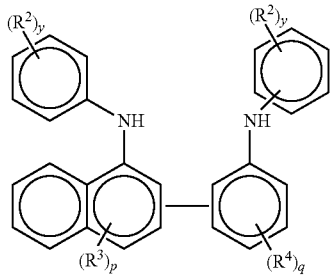

or (D)

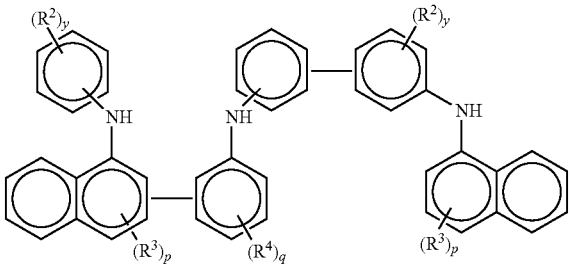

where $R^2$ is a styrene or $C_1$ to $C_{30}$alkyl, $R^3$ is a styrene or $C_1$ to $C_{30}$alkyl, $R^4$ is a styrene or $C_1$ to $C_{30}$ alkyl, preferably $R_2$ is a $C_1$ to $C_{30}$alkyl, $R_3$ is a $C_1$ to $C_{30}$alkyl, $R_4$ is a $C_1$ to $C_{30}$alkyl, more preferably $R_2$ is a $C_4$ to $C_{10}$alkyl, $R_3$ is a $C_4$ to $C_{10}$alkyl and $R_4$ is a $C_4$ to $C_{10}$alkyl, p, q and y individually range from 0 to up to the valence of the aryl group to which the respective R group(s) are attached, preferably at least one of p, q and y range from 1 to up to the valence of the aryl group to which the respective R group(s) are attached, more preferably p, q and y each individually range from at least 1 to up to the valence of the aryl group to which the respective R groups are attached. Other more extensive oligomers are within the scope of this disclosure, but materials of formulae A, B, C and D are preferred. Examples can also be found in U.S. Pat. No. 8,492,321.

Dispersant

The lubricant compositions of the present disclosure may also include one or more dispersants. During engine operation, oil-insoluble oxidation byproducts can be produced. Dispersants can help keep these byproducts in solution, thus diminishing their deposition on metal surfaces. Dispersants used in the formulation of the lubricating composition can be ashless or ash-forming in nature. Preferably, the dispersant is ashless, meaning that it is an organic material that forms substantially no ash upon combustion. For example, non-metal-containing or borated metal-free dispersants are considered ashless. In contrast, metal-containing detergents discussed above form ash upon combustion.

Such dispersants may be present in the lubricant composition in an amount from about 0.1 mass % to about 20.0 mass % (or about 0.5 mass % to about 8.0 mass %, or about 0.5 mass % to 4.0 mass %), based on a total weight of the lubricant composition. The hydrocarbon numbers of the dispersant atoms can range from C60 to C1000, or from C70 to C300, or from C70 to C200. These dispersants may contain both neutral and basic nitrogen or mixtures of both. The dispersants can be end-capped by borates and/or cyclic carbonates.

Suitable dispersants can contain a polar group attached to a relatively high molecular weight hydrocarbon chain. The polar group typically contains at least one element of nitrogen, oxygen, or phosphorus. Typical hydrocarbon chains contain 50 carbon atoms to 400 carbon atoms.

A particularly useful class of dispersants are the alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil is normally a polyisobutylene group. Many examples of this type of dispersant are well known commercially and in the literature. See, for example, U.S. Pat. Nos. 3,172,892; 3,215,707; 3,219,666; 3,316,177; 3,341,542; 3,444,170; 3,454,607; 3,541,012; 3,630,904; 3,632,511; 3,787,374; and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; and 5,705,458. A further description of dispersants can be found, for example, in European Patent Application No. 471 071.

Hydrocarbyl-substituted succinic acid and hydrocarbyl-substituted succinic anhydride derivatives also can be used as dispersants. In particular, succinimide, succinate esters, or succinate ester amides prepared by the reaction of a hydrocarbon-substituted succinic acid compound, preferably having at least 50 carbon atoms in the hydrocarbon substituent, with at least one equivalent of an alkylene amine, are particularly useful. On occasion, having a hydrocarbon substituent having 20 to 50 carbon atoms can be useful.

Succinimides can be formed by the condensation reaction between hydrocarbyl substituted succinic anhydrides and amines. Molar ratios can vary depending on the polyamine. For example, the molar ratio of hydrocarbyl substituted succinic anhydride to TEPA can vary from 1:1 to 5:1. Representative examples are shown in U.S. Pat. Nos. 3,087,936; 3,172,892; 3,219,666; 3,272,746; 3,322,670; 3,652,616; and 3,948,800; and in Canada Patent No. 1,094,044.

Succinate esters can be formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful dispersant.

Succinate ester amides can be formed by a condensation reaction between hydrocarbyl substituted succinic anhydrides and alkanol amines. Suitable alkanol amines include, but are not limited to, ethoxylated polyalkylpolyamines, propoxylated polyalkylpolyamines, and polyalkenylpolyamines such as polyethylene polyamines, the like, or any combination thereof. One example is propoxylated hexamethylenediamine. Representative examples are shown in U.S. Pat. No. 4,426,305.

The molecular weight of the hydrocarbyl substituted succinic anhydrides typically ranges between 800 and 2,500 or more. The above products can be post-reacted with various reagents such as, for example, sulfur, oxygen, formaldehyde, and carboxylic acids such as oleic acid. The above products can also be post reacted with boron compounds such as, for example, boric acid, borate esters, and highly borated dispersants, to form borated dispersants generally having from 0.1 moles to 5.0 moles of boron per mole of dispersant reaction product.

Mannich based dispersants can also be used and are made from the reaction of alkylphenols, formaldehyde, and amines. Sec U.S. Pat. No. 4,767,551, which is incorporated herein by reference. Process aids and catalysts, such as oleic acid and sulfonic acids, can also be part of the reaction mixture. Molecular weights of the alkylphenols can range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products can be prepared from high molecular weight alkyl-substituted hydroxyaromatics or $HNR_2$group-containing reactants.

Hydrocarbyl substituted amine ashless dispersant additives are well known to those skilled in the art. Sec, for example, U.S. Pat. Nos. 3,275,554; 3,438,757; 3,565,804; 3,755,433; 3,822,209; and 5,084,197.

Preferred dispersants may include, but are not limited to, borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn from 500 to 5,000 (or 1,000 to 3,000, or 1,000 to 2,000), or a mixture of such hydrocarbylene groups, often with high terminal vinylic groups. Other preferred dispersants include succinic acid-esters and amides, alkylphenol-polyamine-coupled Mannich adducts, their capped derivatives, and other related components.

Polymethacrylate or polyacrylate derivatives are another class of dispersants. These dispersants are typically prepared by reacting a nitrogen-containing monomer and a methacrylic or acrylic acid ester containing 5 carbon atoms to 25 carbon atoms in the ester group. Representative examples are shown in U.S. Pat. Nos. 2,100,993 and 6,323,164. Polymethacrylate and polyacrylate dispersants are normally used as multifunctional viscosity index improvers. The lower molecular weight versions can be used as lubricant dispersants or fuel detergents.

The use of polymethacrylate or polyacrylate dispersants are preferred in polar esters of a non-aromatic dicarboxylic acid, preferably adipate esters, since many other conventional dispersants are less soluble. The preferred dispersants for polyol esters include polymethacrylate and polyacrylate dispersants.

Viscosity Index Improver

One or more viscosity index improvers (also known as VI improvers, viscosity modifiers, and viscosity improvers) may be included in the lubricant compositions of the present disclosure. Viscosity index improvers can serve to provide lubricants with high and low temperature operability. These additives impart shear stability at elevated temperatures and acceptable viscosity at low temperatures. The viscosity index improver can be present in the lubricant composition in an amount from about 1.0 mass % to about 20.0 mass % (or about 5.0 mass % to about 15.0 mass %, or about 8.0 to about 12.0 mass %), based on the total mass of the lubricant composition.

Suitable viscosity index improvers include high molecular weight hydrocarbons, polyesters, and viscosity index improver dispersants that function as both a viscosity index improver and a dispersant. Typical molecular weights of these polymers are between about 10,000 to 1,500,000, more typically about 20,000 to about 1,200,000, and even more typically about 50,000 to about 1,000,000. The typical molecular weight for polymethacrylate or polyacrylate viscosity index improvers is less than about 50,000.

Examples of suitable viscosity index improvers are linear or star-shaped polymers and copolymers of methacrylate, butadiene, olefins, or alkylated styrenes. Polyisobutylene is a commonly used viscosity index improver. Another suitable viscosity index improver is polymethacrylate (e.g., copolymers of various chain length alkyl methacrylates), some formulations of which also serve as pour point depressants. Other suitable viscosity index improvers include, but are not limited to, copolymers of ethylene and propylene, hydrogenated block copolymers of styrene and isoprene, and polyacrylates (copolymers of various chain length acrylates, for example). Specific examples include, but are not limited to, styrene-isoprene or styrene-butadiene based polymers having a molecular weight of about 50,000 to 200,000.

Suitable olefin copolymers include, but are not limited to, those commercially available from: Chevron Oronite under the tradename PARATONE® (such as PARATONEX® 8921 and PARATONE® 8941); Afton Chemical Corporation under the tradename HITEC® (such as HITEC® 5850B); and The Lubrizol Corporation under the tradename LUBRIZOL® 7067C. Hydrogenated polyisoprene star polymers may include, but are not limited to, those commercially available from Infineum International under the tradename SV200 and SV600. Hydrogenated diene-styrene block copolymers may include, but are not limited to, commercially available from Infineum International, e.g., under the tradename SV 50.

Other Additives

The lubricant compositions may additionally include other lubricant performance additives known in the art such as corrosion inhibitors, rust inhibitors, metal deactivators, extreme pressure additives, anti-seizure agents, wax modifiers, viscosity modifiers, fluid-loss additives, seal compatibility agents, friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973), see also U.S. Pat. No. 7,704,930, which is incorporated by reference herein in its entirety. These additives are commonly delivered with varying amounts of diluent oil that may, for example, range from 5 mass % to 50 mass %. When lubricant compositions include one or more of the foregoing additives, the additive (s) may be blended into a "concentrate," a "premix," or a "slurry" to allow further use when blending a fully formulated lubricant.

EXAMPLES

To facilitate a better understanding of the embodiments of the present invention, the following examples of preferred or representative embodiments are given. In no way should the following examples be read to limit, or to define, the scope of the invention.

The foregoing discussion can be further described with reference to the following non-limiting examples.

Experiment 1

Example lubricant formulations (A1-A13) were made that contained alkylated naphthalene and squalane as the base oil, a nonionic detergent, an amine phosphate antiwear additive, and a phenolic antioxidant combined with one or more aminic antioxidants, as well as one or more metal detergents. A1-A5 included calcium phenate as a metal detergent, while A6-A9 and A10-A13 included calcium sulfonate and magnesium sulfonate, respectively. Additionally, a conventional synthetic engine oil was prepared as a comparative example (CE1), containing a conventional viscosity index improver, dispersant, detergent, antioxidant, pour point depressant, and antifoam additive.

The specific mass % of each component is provided below in Table 1 for CEL and A1-A5, and in Table 2 for A6-A13, where all mass percentages are based on the total mass of the lubricant formulation.

The alkylated naphthalene used in A1-A13 was SYNNESTIC™ 5, which is commercially available from ExxonMobil Chemical. The squalane used in A1-A13 was NEOSSANCE® squalane, which is commercially available from Aprinnova. The calcium phenate detergent used comprised Oronite OLOA® 218A (available from Chevron Oronite), while the calcium sulfonate detergent used comprised INFINEUM® C9330 and the magnesium sulfonate detergent used comprised INFINEUM® C9340 (both available from Infineium International). Each formulation was made by adding each component of the formulation to a beaker heated to a temperature of 70° C. to 85° C. followed by blending the components together with a stirrer.

TABLE 1

Compositions and experimental results for CE1 and A1-A5.

| | CE1 | A1 | A2 | A3 | A4 | A5 |
|---|---|---|---|---|---|---|
| SYNNESTIC(TM) 5 (alkylated naphthalene) mass % | — | 20.00 | 20.00 | 20.00 | 20.00 | 20.00 |
| NEOSSANCE(R) squalane mass % | — | 62.58 | 62.38 | 62.18 | 61.98 | 61.78 |
| Phenolic antioxidants mass % | — | 1.00 | 1.00 | 1.00 | 1.00 | 1.00 |
| p,p'-dioctyldiphenylamine mass % | — | 3.00 | 3.00 | 3.00 | 3.00 | 3.00 |
| Octylated phenyl-alpha-naphthylamine mass % | — | 0.95 | 0.95 | 0.95 | 0.95 | 0.95 |
| Nonionic detergent mass % | — | 0.95 | 0.95 | 0.95 | 0.95 | 0.95 |
| Amine Phosphate mass % | — | 0.25 | 0.25 | 0.25 | 0.25 | 0.25 |
| Calcium Sulfonate Detergent mass % | — | 0 | 0 | 0 | 0 | 0 |
| Magnesium Sulfonate Detergent mass % | — | 0 | 0 | 0 | 0 | 0 |
| Calcium Phenate Detergent mass % | — | 0 | 0.20 | 0.40 | 0.60 | 0.80 |
| Other additive mixture mass % | — | 11.27 | 11.27 | 11.27 | 11.27 | 11.27 |
| Calcium mass % (ASTM D4591-22) | 0.331 | <0.001 | 0.0096 | 0.0224 | 0.0342 | 0.046 |

TABLE 1-continued

Compositions and experimental results for CE1 and A1-A5.

| | CE1 | A1 | A2 | A3 | A4 | A5 |
|---|---|---|---|---|---|---|
| Magnesium mass % (ASTM D4591-22) | 0.002 | <0.001 | <0.001 | <0.001 | <0.001 | <0.001 |
| Molybdenum mass % (ASTM D4591-22) | 0.008 | <0.001 | <0.001 | <0.001 | <0.001 | <0.001 |
| Sulfur mass % (ASTM D6443) | 0.231 | <0.0005 | 0.0074 | 0.0144 | 0.0208 | 0.0272 |
| Phosphorus mass % (ASTM D4591-22) | 0.101 | 0.009 | 0.008 | 0.01 | 0.01 | 0.01 |
| Zinc mass % (ASTM D4591-22) | 0.107 | <0.001 | <0.001 | <0.001 | <0.001 | <0.001 |
| Sulfated Ash mass % (calculated) | 1.404 | 0 | 0.0327 | 0.0761 | 0.116 | 0.156 |
| Seq. IIIE Screener (165° C.), hours to 200% Viscosity Increase | 322 | 954 | 570 | 440 | 254 | 220 |
| Bio-based carbon % (ASTM D6866-22) | 0 | ≥62.58 | ≥62.38 | ≥62.18 | ≥61.98 | ≥61.78 |

TABLE 2

Compositions and experimental results for A6-A13.

| | A6 | A7 | A8 | A9 | A10 | A11 | A12 | A13 |
|---|---|---|---|---|---|---|---|---|
| SYNNESTIC(TM) 5 (alkylated naphthalene) mass % | 20.00 | 20.00 | 20.00 | 20.00 | 20.00 | 20.00 | 20.00 | 20.00 |
| NEOSSANCE(R) squalane mass % | 62.38 | 62.18 | 61.98 | 61.78 | 62.38 | 62.18 | 61.98 | 61.78 |
| Phenolic antioxidants mass % | 1.00 | 1.00 | 1.00 | 1.00 | 1.00 | 1.00 | 1.00 | 1.00 |
| p,p'-dioctyldiphenylamine mass % | 3.00 | 3.00 | 3.00 | 3.00 | 3.00 | 3.00 | 3.00 | 3.00 |
| Octylated phenyl-alpha-naphthylamine mass % | 0.95 | 0.95 | 0.95 | 0.95 | 0.95 | 0.95 | 0.95 | 0.95 |
| Nonionic detergent mass % | 0.95 | 0.95 | 0.95 | 0.95 | 0.95 | 0.95 | 0.95 | 0.95 |
| Amine Phosphate mass % | 0.25 | 0.25 | 0.25 | 0.25 | 0.25 | 0.25 | 0.25 | 0.25 |
| Calcium Sulfonate Detergent mass % | 0.20 | 0.40 | 0.60 | 0.80 | 0 | 0 | 0 | 0 |
| Magnesium Sulfonate Detergent mass % | 0 | 0 | 0 | 0 | 0.20 | 0.40 | 0.60 | 0.80 |
| Calcium Phenate Detergent mass % | 0 | 0 | 0 | 0 | 0 | 0 | 0 | 0 |
| Other additive mixture mass % | 11.27 | 11.27 | 11.27 | 11.27 | 11.27 | 11.27 | 11.27 | 11.27 |
| Calcium mass % (ASTM D4591-22) | 0.0236 | 0.0482 | 0.0709 | 0.0954 | <0.001 | <0.001 | <0.001 | <0.001 |
| Magnesium mass % (ASTM D4591-22) | <0.001 | <0.001 | <0.001 | <0.001 | 0.0186 | 0.0363 | 0.0548 | 0.0735 |
| Molybdenum mass % (ASTM D4591-22) | <0.001 | <0.001 | <0.001 | <0.001 | <0.001 | <0.001 | <0.001 | <0.001 |
| Sulfur mass % (ASTM D6443) | 0.0042 | 0.0068 | 0.0095 | | 0.0047 | 0.008 | 0.011 | 0.0144 |
| Phosphorus mass % (ASTM D4591-22) | 0.01 | 0.01 | 0.01 | 0.01 | 0.01 | 0.01 | 0.01 | 0.01 |
| Zinc mass % (ASTM D4591-22) | <0.001 | <0.001 | <0.001 | <0.001 | <0.001 | <0.001 | <0.001 | <0.001 |
| Sulfated Ash mass % (calculated) | 0.0802 | 0.164 | 0.241 | 0.324 | 0.0921 | 0.180 | 0.271 | 0.364 |
| Seq. IIIE Screener (165° C.), hours to 200% Viscosity Increase | 226 | 192 | 162 | 162 | 167 | 166 | 153 | 144 |
| Bio-based carbon % (ASTM D6866-22) | ≥62.38 | ≥62.18 | ≥61.98 | ≥61.78 | ≥62.38 | ≥62.18 | ≥61.98 | ≥61.78 |

The foregoing formulations of Experiment 1 were tested to determine various properties thereof, as shown in Tables 1 and 2 above. The calcium mass % was found to be less than 0.1 for the formulations in A1-A13 using ASTM D4591-22, whereas the calcium mass % was found to be higher (0.331 mass %) for the synthetic engine oil in CE1. The molybdenum mass % was found to be less than 0.001 for the formulations in A1-A13 using ASTM D4591-22, whereas the molybdenum mass % was found to be higher (0.008 mass %) for the synthetic engine oil in CE1. The zinc mass % was found to be less than 0.001 for the formulations in A1-A13 using ASTM D4591-22, whereas the zinc mass % was found to be higher (0.107 mass %) for the synthetic engine oil in CE1. The phosphorus mass % was found to 0.01 or less for the formulations in A1-A13 using ASTM D4591-22, whereas the phosphorus mass % was found to be higher (0.101 mass %) for the synthetic engine oil in CE1. The sulfur mass % was found to be 0.03 mass % or less for the formulations in A1-A13, whereas it was found to be higher (0.231 mass %) for the synthetic engine oil in CE1 using ASTM D6443-22. Sulfated ash mass % was calculated (see Simon A.G. Watson, MIT Ph.D. thesis, 2010, "Lubricant-Derived Ash-In-Engine Sources and Opportunities for Reduction", Page 37).

All the formulations of Experiment 1 were subjected to a bench oxidation test (Sequence IIIE screener) that was conducted at 165° C., under a flow of 500 mL/min of air, with 40 ppm of iron from ferric acetylacetonate, which was added as a catalyst. Oil samples were taken periodically, and their viscosities at 40° C. were measured using a Houillon viscometer. The time (hours) to reach 200% viscosity increase was recorded for each example. Additionally, bio-based carbon content was calculated for all formulations of Experiment 1 according to ASTM D6866-22.

As indicated in Tables 1 and 2 and as shown in the FIGURE, the 200% viscosity increase time (Sequence IIIE screener) was surprisingly higher for A1-A3 (comprising calcium phenate at a mass % of 0.4 or less, including comprising no metal detergent) than that of the formulations of A4-A13 (comprising calcium sulfonate or magnesium sulfonate, or comprising calcium phenate at a mass % of 0.6 or greater) or of CE1. Without intending to be limited by theory, the combination of squalane as a base stock oil and the low mass % addition of metal detergent appears to have a synergistic effect so as to increase the time to reach 200% viscosity increase (Sequence IIIE screener). Simultaneously, A1-A3 maintain such high oxidation stability while retaining 60% or greater bio-based carbon content (ASTM D6866-22).

Experiment 2

Example lubricant formulations (B1-B21) were made that contained indicated basestock oils (of API type Group II and/or Group III), a nonionic detergent, a amine phosphate antiwear additive, a mixture of phenolic and aminic antioxidants. Some examples contained additional additives including, for example, a pentaerythritol ester. Additionally, three (3) comparative example formulations (CE2, CE3, and CE4) were prepared with basestocks of only a poly-alphaolefin, only a squalane, and only alkylated naphthalene, respectively.

The specific mass % of each component is provided below in Table 3 for CE2-CE4, Table 4 for B1-B6, Table 5 for B7-B11, Table 6 for B12-B15, and Table 7 for B16-B21, where all mass percentages are based on the total mass of the lubricant formulation.

The alkylated naphthalene used in B1-B21 and CE4 was SYNNESTIC™ 5, which is commercially available from ExxonMobil Chemical. The squalane used in B1-B21 and CE3 was NEOSSANCE® squalane which is commercially available from Aprinnova. The basestock oil used in CE2 comprised a poly-alphaolefin, specifically SPECTRASYN 6™, which is commercially available from ExxonMobil Chemical. A basestock oil used in B10-B11 comprised trimethylolpropane 3,5,5-trimethylhexanoate ester. Another basestock oil used in B12, B14-B15 comprised EHC™ 45, available commercially from ExxonMobil Chemical. Another basestock oil used in B16-B19 comprised YUBASE™ 4, available commercially from SK Lubricants. Another basestock oil used in B20-B21 comprised QHVI 4, available commercially from Shell Lubricants. The pentaerythritol ester used in B13-B21 comprised NYCOBASE™ 1040X, available commercially from Nyco Group. Nycobase™ 1040X includes mixed pentaerythritol esters of branched alkanoic acids. Such mixed esters may have properties including from about 1 mol % to about 5 mol % primary carbon, from about 30 mol % to about 40 mol % secondary carbon, and from about 40 mol % to about 50 mol % tertiary carbon, and from about 15 mol % to about 25 mol % quanternary carbon (as determined by carbon-13 NMR).

Each formulation was made by adding each component of the formulation to a beaker heated to a temperature of 70° C. to 85° C. followed by blending the components together with a stirrer.

TABLE 3

Compositions and experimental results for CE2-CE4.

| | CE2 | CE3 | CE4 |
|---|---|---|---|
| SYNNESTIC(TM) 5 (alkylated naphthalene) mass % | | | 84.63 |
| SPECTRASYN ™ 6 (poly-alphaolefin) mass % | 84.63 | | |
| NEOSSANCE(R) squalane mass % | | 84.63 | |
| Phenolic antioxidants mass % | 1 | 1 | 1 |
| p, p'-dioctyldiphenylamine mass % | 0.95 | 0.95 | 0.95 |
| Octylated phenyl-alpha-naphthylamine mass % | 0.95 | 0.95 | 0.95 |
| Nonionic detergent mass % | 0.95 | 0.95 | 0.95 |
| Amine Phosphate mass % | 0.25 | 0.25 | 0.25 |
| Other additive mixture mass % | 11.27 | 11.27 | 11.27 |
| Calcium mass % (ASTM D4591-22) | <0.001 | <0.001 | <0.001 |
| Molybdenum mass % (ASTM D4591-22) | <0.001 | <0.001 | <0.001 |
| Phosphorus mass % (ASTM D4591-22) | 0.008 | 0.009 | 0.008 |
| Zinc mass % (ASTM D4591-22) | <0.001 | <0.002 | <0.001 |
| Sulfur mass % (calculated) | 0 | 0 | 0 |
| Sulfated ash mass % (calculated) | 0 | 0 | 0 |
| HPDSC Onset temperature (° C.) | 258 | 241 | 266 |
| Seq. IIIE Screener (165° C.), hours to 200% Viscosity Increase | 428 | 228 | 667 |
| Bio-based carbon % (ASTM D6866-22) | | ≥84.63 | |

TABLE 4

Compositions and experimental results for B1-B6.

| | B1 | B2 | B3 | B4 | B5 | B6 |
|---|---|---|---|---|---|---|
| SYNNESTIC(TM) 5 (alkylated naphthalene) mass % | 5 | 10 | 20 | 44.63 | 60 | 20 |
| NEOSSANCE(R) squalane mass % | 79.63 | 74.63 | 64.63 | 40 | 24.63 | 55.58 |
| Phenolic antioxidants mass % | 1 | 1 | 1 | 1 | 1 | 1 |
| p,p'-dioctyldiphenylamine mass % | 0.95 | 0.95 | 0.95 | 0.95 | 0.95 | |
| Octylated phenyl-alpha-naphthylamine mass % | 0.95 | 0.95 | 0.95 | 0.95 | 0.95 | 0.95 |
| Polymerized amine antioxidant concentrate mass % | | | | | | 10 |
| Nonionic detergent mass % | 0.95 | 0.95 | 0.95 | 0.95 | 0.95 | 0.95 |
| Amine Phosphate mass % | 0.25 | 0.25 | 0.25 | 0.25 | 0.25 | 0.25 |

TABLE 4-continued

Compositions and experimental results for B1-B6.

| | B1 | B2 | B3 | B4 | B5 | B6 |
|---|---|---|---|---|---|---|
| Other additive mixture mass % | 11.27 | 11.27 | 11.27 | 11.27 | 11.27 | 11.27 |
| Calcium mass % (ASTM D4591-22) | <0.001 | <0.001 | <0.001 | <0.001 | <0.001 | <0.001 |
| Molybdenum mass % (ASTM D4591-22) | <0.001 | <0.001 | <0.001 | <0.001 | <0.001 | <0.001 |
| Phosphorus mass % (ASTM D4591-22) | 0.009 | 0.009 | 0.009 | 0.009 | 0.009 | 0.008 |
| Zinc mass % (ASTM D4591-22) | <0.001 | <0.001 | <0.001 | <0.001 | <0.001 | <0.001 |
| Sulfur mass % (calculated) | 0 | 0 | 0 | 0 | 0 | 0 |
| Sulfated Ash mass % (calculated) | 0 | 0 | 0 | 0 | 0 | 0 |
| HPDSC Onset temperature (° C.) | 245 | 243 | 245 | 253 | 254 | 247 |
| Seq. IIIE Screener (165° C.), hours to 200% Viscosity Increase | 240 | 219 | 433 | 863 | 837 | 945 |
| Bio-based carbon % (ASTM D6866-22) | ≥79.63 | ≥74.63 | ≥64.63 | ≥40 | ≥24.63 | ≥55.58 |

TABLE 5

Compositions and experimental results for B7-B11.

| | B7 | B8 | B9 | B10 | B11 |
|---|---|---|---|---|---|
| SYNNESTIC(TM) 5 (alkylated naphthalene) mass % | 10 | 15 | 20 | 10 | 10 |
| NEOSSANCE(R) squalane mass % | 72.58 | 67.58 | 62.58 | 67.58 | 62.58 |
| Trimethylolpropane 3,5,5-trimethylhexanoate ester mass % | | | | 5 | 10 |
| Phenolic antioxidants mass % | 1 | 1 | 1 | 1 | 1 |
| p, p'-dioctyldiphenylamine mass % | 3 | 3 | 3 | 3 | 3 |
| Octylated phenyl-alpha-naphthylamine mass % | 0.95 | 0.95 | 0.95 | 0.95 | 0.95 |
| Nonionic detergent mass % | 0.95 | 0.95 | 0.95 | 0.95 | 0.95 |
| Amine Phosphate mass % | 0.25 | 0.25 | 0.25 | 0.25 | 0.25 |
| Other additive mixture mass % | 11.27 | 11.27 | 11.27 | 11.27 | 11.27 |
| Calcium mass % (ASTM D4591-22) | <0.001 | <0.001 | <0.001 | <0.001 | <0.001 |
| Molybdenum mass % (ASTM D4591-22) | <0.001 | <0.001 | <0.001 | <0.001 | <0.001 |
| Phosphorus mass % (ASTM D4591-22) | 0.009 | 0.009 | 0.008 | 0.010 | 0.010 |
| Zinc mass % (ASTM D4591-22) | <0.001 | <0.001 | <0.001 | <0.001 | <0.001 |
| Sulfur mass % (calculated) | 0 | 0 | 0 | 0 | 0 |
| Sulfated Ash mass % (calculated) | 0 | 0 | 0 | 0 | 0 |
| HPDSC Onset temperature (° C.) | 252 | 247 | 256 | 253 | 243 |
| Seq. IIIE Screener (165° C.), hours to 200% Viscosity Increase | 332 | 382 | 1070 | 529 | 980 |
| Bio-based carbon % (ASTM D6866-22) | ≥72.58 | ≥67.58 | ≥62.58 | ≥67.58 | ≥62.58 |

TABLE 6

Compositions and experimental results for B12-B15.

| | B12 | B13 | B14 | B15 |
|---|---|---|---|---|
| SYNNESTIC(TM) 5 (alkylated naphthalene) mass % | 12.00 | 12.00 | 12.00 | 12.00 |
| NEOSSANCE(R) squalane mass % | 35.19 | 63.38 | 25.00 | 31.69 |
| EHC(TM) 45 (basestock oil) mass % | 35.19 | | 38.38 | 31.69 |
| Phenolic antioxidants mass % | 1.00 | 1.00 | 1.00 | 1.00 |
| p, p'-dioctyldiphenylamine mass % | 3.00 | 3.00 | 3.00 | 3.00 |
| Octylated phenyl-alpha-naphthylamine mass % | 0.95 | 0.95 | 0.95 | 0.95 |
| Nonionic detergent mass % | 0.95 | 0.95 | 0.95 | 0.95 |
| Amine Phosphate mass % | 0.25 | 0.25 | 0.25 | 0.25 |
| NYCOBASE(TM) 1040X (pentaerythritol ester) mass % | | 7.00 | 7.00 | 7.00 |
| Other additive mixture mass % | 11.47 | 11.47 | 11.47 | 11.47 |
| Calcium mass % (ASTM D4591-22) | <0.001 | <0.001 | <0.001 | <0.001 |
| Molybdenum mass % (ASTM D4591-22) | <0.001 | <0.001 | <0.001 | <0.001 |
| Phosphorus mass % (ASTM D4591-22) | 0.009 | 0.010 | 0.010 | 0.009 |
| Zinc mass % (ASTM D4591-22) | <0.001 | <0.001 | <0.001 | <0.001 |
| Sulfur mass % (calculated) | 0 | 0 | 0 | 0 |
| Sulfated Ash mass % (calculated) | 0 | 0 | 0 | 0 |

TABLE 6-continued

Compositions and experimental results for B12-B15.

| | B12 | B13 | B14 | B15 |
|---|---|---|---|---|
| HPDSC Onset temperature (° C.) | 252 | 256 | 246 | 256 |
| Seq. IIIE Screener (165° C.), hours to 200% Viscosity Increase | 275 | 405 | 1236 | 815 |
| Bio-based carbon % (ASTM D6866-22) | ≥35.19 | ≥63.38 | ≥25.00 | ≥31.69 |

TABLE 7

Compositions and experimental results for B16-B21.

| | B16 | B17 | B18 | B19 | B20 | B21 |
|---|---|---|---|---|---|---|
| SYNNESTIC(TM) 5 (alkylated naphthalene) mass % | 2.00 | 12.00 | 12.00 | 22.00 | 12.00 | 12.00 |
| NEOSSANCE(R) squalane mass % | 36.69 | 25.00 | 31.69 | 26.69 | 25.00 | 31.69 |
| YUBASE(TM) 4 (basestock oil) mass % | 36.69 | 38.38 | 31.69 | 26.69 | | |
| QHVI 4 (basestock oil) mass % | | | | | 38.38 | 31.69 |
| Phenolic antioxidants mass % | 1.00 | 1.00 | 1.00 | 1.00 | 1.00 | 1.00 |
| p,p'-dioctyldiphenylamine mass % | 3.00 | 3.00 | 3.00 | 3.00 | 3.00 | 3.00 |
| Octylated phenyl-alpha-naphthylamine mass % | 0.95 | 0.95 | 0.95 | 0.95 | 0.95 | 0.95 |
| Nonionic detergent mass % | 0.95 | 0.95 | 0.95 | 0.95 | 0.95 | 0.95 |
| Amine Phosphate mass % | 0.25 | 0.25 | 0.25 | 0.25 | 0.25 | 0.25 |
| NYCOBASE(TM) 1040X (pentaerythritol ester) mass % | 7.00 | 7.00 | 7.00 | 7.00 | 7.00 | 7.00 |
| Other additive mixture mass % | 11.47 | 11.47 | 11.47 | 11.47 | 11.47 | 11.47 |
| Calcium mass % (ASTM D4591-22) | <0.001 | <0.001 | <0.001 | <0.001 | <0.001 | <0.001 |
| Molybdenum mass % (ASTM D4591-22) | <0.001 | <0.001 | <0.001 | <0.001 | <0.001 | <0.001 |
| Phosphorus mass % (ASTM D4591-22) | 0.010 | 0.010 | 0.009 | 0.010 | 0.009 | 0.009 |
| Zinc mass % (ASTM D4591-22) | <0.001 | <0.001 | <0.001 | <0.001 | <0.001 | <0.001 |
| Sulfur mass % (calculated) | 0 | 0 | 0 | 0 | 0 | 0 |
| Sulfated Ash mass % (calculated) | 0 | 0 | 0 | 0 | 0 | 0 |
| HPDSC Onset temperature (° C.) | 246 | 249 | 258 | 262 | 245 | 242 |
| Seq. IIIE Screener (165° C.), hours to 200% Viscosity Increase | 371 | 854 | 1039 | 912 | 1094 | 800 |
| Bio-based carbon % (ASTM D6866-22) | ≥36.69 | ≥25.00 | ≥31.69 | ≥26.69 | ≥25.00 | ≥31.69 |

The foregoing formulations were tested to determine various properties thereof, as shown in Tables 3-7 above. All the formulations of Experiment 2 were subjected to a bench oxidation test (Sequence IIIE screener), as described for Experiment 1 above. Bio-based carbon content was calculated for all formulations of Experiment 2 according to ASTM D6866-22. Additionally, all the formulations in Experiment 2 were subjected to a High Pressure Differential Scanning calorimetry (HPDSC) test in which the oxidation onset temperature was measured with a Universal V4.5A TA instrument equipped with a Q20 Tzero Pressure DSC Cell. The test method was similar to ASTM E2009-08 Test Method B except that 500 psig of air was used instead of 500 psig of oxygen and the sample size was 3.0 mg+/−0.2 mg. The pressurized sample was first equilibrated at 50° C. and then ramped up to 400° C. at 10° C./min.

Additional Embodiments

Embodiment 1. A lubricant composition for use as an engine oil, comprising: from about 25.0 mass % to about 99.8 mass % of an oil base stock, based on a total mass of the lubricant composition, the oil base stock comprising at least one bio-sourced basestock and at least one alkyl naphthalene; and wherein the lubricant composition comprises about 0.05 mass % or less phosphorus, about 0.05 mass % or less sulfur, and about 0.5 mass % or less ash.

Embodiment 2. The lubricant composition of Embodiment 1, wherein the lubricant composition further comprises about from about 0.05 mass % to about 1.0 mass % of at least one metal detergent, based on the total mass of the lubricant composition.

Embodiment 3. The lubricant composition of Embodiment 1, wherein the lubricant composition further comprises a nonzero amount of at least one metal detergent, and wherein the lubricant composition comprises 0.05 mass % or less of the at least one metal detergent, based on the total mass of the lubricant composition.

Embodiment 4. The lubricant composition of Embodiment 1, wherein the lubricant composition further comprises a nonzero amount of at least one metal detergent, and wherein the lubricant composition comprises 0.2 mass % or less of the at least one metal detergent, based on the total mass of the lubricant composition.

Embodiment 5. The lubricant composition of Embodiment 1, wherein the lubricant composition further comprises a nonzero amount of at least one metal detergent, and wherein the lubricant composition comprises 0.5 mass % or less of the at least one metal detergent, based on the total mass of the lubricant composition.

Embodiment 6. The lubricant composition of any one of Embodiments 1-5, further comprising from about 0.1 mass % to about 1.0 mass % of at least one ashless antiwear additive, based on the total mass of the lubricant composition.

Embodiment 7. The lubricant composition of Embodiment 6, wherein the at least one ashless antiwear additive comprises an amine phosphate.

Embodiment 8. The lubricant composition of any one of Embodiments 1-7, further comprising from about 0.1 mass % to about 10.0 mass % of at least one antioxidant, based on the total mass of the lubricant composition.

Embodiment 9. The lubricant composition of Embodiment 8, wherein the at least one antioxidant comprises a phenolic antioxidant, an aminic antioxidant, a polyaminic antioxidant, or combinations thereof.

Embodiment 10. The lubricant composition of any one of Embodiments 1-7, further comprising from about 2.0 mass % to about 5.0 mass % of at least one aminic antioxidant, based on the total mass of the lubricant composition.

Embodiment 11. The lubricant composition of Embodiment 10, wherein the at least one aminic antioxidant comprises a p,p'-dioctyldiphenylamine, an octylated phenyl-alpha-naththylamine, or combinations thereof.

Embodiment 12. The lubricant composition of any one of Embodiments 1-11, wherein the at least one metal detergent comprises an overbased metal detergent.

Embodiment 13. The lubricant composition of any one of Embodiments 1-11, wherein the at least one metal detergent comprises an overbased metal detergent, and wherein the overbased metal detergent comprises calcium sulfonate, magnesium sulfonate, calcium phenate, or any combination thereof.

Embodiment 14. The lubricant composition of any one of Embodiments 1-11, wherein the at least one metal detergent comprises an overbased calcium phenate.

Embodiment 15. The lubricant composition of any one of Embodiments 1-14, wherein the at least one bio-sourced basestock has a bio-based carbon content (ASTM D6866-22) of about 25% or greater.

Embodiment 16. The lubricant composition of any one of Embodiments 1-15, wherein the at least one bio-sourced basestock comprises squalane.

Embodiment 17. The lubricant composition of any one of Embodiments 1-15, wherein the at least one bio-sourced basestock comprises squalane, a polyalphaolefin, an ester, or any combination thereof.

Embodiment 18. The lubricant composition of any one of Embodiments 1-17, wherein the lubricant composition comprises from about 40.0 mass % to about 80.0 mass % of the at least one bio-sourced basestock, based on the total mass of the lubricant composition.

Embodiment 19. The lubricant composition of any one of Embodiments 1-18, wherein the lubricant composition comprises from about 50.0 mass % to about 70.0 mass % of the at least one bio-sourced basestock, based on the total mass of the lubricant composition.

Embodiment 20. The lubricant composition of any one of Embodiments 1-19, wherein the lubricant composition comprises from about 10.0 mass % to about 50.0 mass % of the at least one alkyl naphthalene, based on the total mass of the lubricant composition.

Embodiment 21. The lubricant composition of any one of Embodiments 1-20, wherein the lubricant composition comprises from about 5.0 mass % to about 9.0 mass % of at least one polyol ester, based on the total mass of the lubricant composition.

Embodiment 22. The lubricant composition of any one of Embodiments 1-21, wherein the lubricant composition comprises from about 5.0 mass % to about 9.0 mass % of at least one mixed pentaerythritol esters of branched alkanoic acids, based on the total mass of the lubricant composition.

Embodiment 23. The lubricant composition of any one of Embodiments 1-22, wherein the lubricant composition comprises from about 5.0 mass % to about 9.0 mass % of trimethylolpropane 3,5,5-trimethylhexanoate ester, based on the total mass of the lubricant composition.

Embodiment 24. The lubricant composition of any one of Embodiments 1-23, wherein the lubricant composition comprises from about 15.0 mass % to about 25.0 mass % of the at least one alkyl naphthalene, based on the total mass of the lubricant composition.

Embodiment 25. The lubricant composition of any one of Embodiments 1-24, wherein the lubricant composition has a bio-based carbon content (ASTM D6866-22) of about 25% or greater.

Embodiment 26. The lubricant composition of any one of Embodiments 1-25, wherein the lubricant composition has a bio-based carbon content (ASTM D6866-22) of about 50% or greater.

Embodiment 27. The lubricant composition of any one of Embodiments 1-26, wherein the lubricant composition has a 200% viscosity increase time at 165° C. from about 400 hours to about 1,500 hours, as measured by the Sequence IIIE screener test.

Embodiment 28. The lubricant composition of any one of Embodiments 1-27, wherein the lubricant composition has a 200% viscosity increase time at 165° C. from about 500 hours to about 1,000 hours, as measured by the Sequence IIIE screener test.

Embodiment 29. The lubricant composition of any one of Embodiments 1-28, wherein the lubricant composition comprises less than about 0.03 mass % phosphorus, less than about 0.03 mass % sulfur, and less than about 0.03 mass % ash.

Embodiment 30. The lubricant composition of any one of Embodiments 1-29, wherein the lubricant composition comprises less than about 0.01 mass % phosphorus, less than about 0.01 mass % sulfur, and less than about 0.01 mass % ash.

Embodiment 31. A lubricant composition for use as an engine oil, comprising: from about 25.0 mass % to about 99.8 mass % of an oil base stock, based on a total mass of the lubricant composition, the oil base stock comprising at least one bio-sourced basestock and at least one alkyl naphthalene, wherein the lubricant composition comprises from about 40.0 mass % to about 80.0 mass % of the at least one bio-sourced basestock, and wherein the lubricant composition comprises about 10.0 mass % to 30.0 mass % of the at least one alkyl naphthalene; from about 0.0 mass % to about 1.0 mass % of at least one metal detergent, based on the total mass of the lubricant composition; from about 0.1 mass % to about 1.0 mass % of at least one ashless antiwear additive; from about 0.1 mass % to about 10.0 mass % of at least one antioxidant; wherein the lubricant composition comprises about 0.05 mass % or less phosphorus, about 0.05 mass % or less sulfur, and about 0.5 mass % or less ash.

Embodiment 32. A process for making a lubricant composition, comprising: combining from about 25.0 mass % to about 99.8 mass % of an oil base stock, based on a total mass of the lubricant composition, the oil base stock comprising at least one bio-sourced basestock and at least one alkyl naphthalene, and from about 0.0 mass % to about 1.0 mass % of at least one metal detergent, based on the total mass of the lubricant composition; wherein the lubricant composition comprises about 0.05 mass % or less phosphorus, about 0.05 mass % or less sulfur, and about 0.05 mass % or less ash.

Embodiment 33. The process of Embodiment 31, wherein the lubricant composition comprises a nonzero amount of the at least one metal detergent, and wherein the lubricant composition comprises 0.5 mass % or less of the at least one metal detergent, based on the total mass of the lubricant composition.

Embodiment 34. The process of Embodiment 32 or 33, wherein the at least one metal detergent comprises an overbased calcium phenate.

Embodiment 35. The process of any one of Embodiments 32-34, wherein the at least one bio-sourced basestock comprises squalane.

Embodiment 36. The process of any one of Embodiments 32-36, wherein the lubricant composition has a bio-based carbon content (ASTM D6866-22) of about 25% or greater.

Embodiment 37. The process of any one of Embodiments 32-36, wherein the lubricant composition has a bio-based carbon content (ASTM D6866-22) of about 50% or greater.

Embodiment 38. The process of Embodiments 32-37, wherein the lubricant composition comprises from about 10.0 mass % to about 30.0 mass % of the at least one alkyl naphthalene, based on the total mass of the lubricant composition.

Embodiment 39. The process of Embodiments 32-38, wherein the lubricant composition comprises about 0.03 mass % or less phosphorus, about 0.03 mass % or less sulfur, and about 0.03 mass % or less ash.

Therefore, the present invention is well adapted to attain the ends and advantages mentioned as well as those that are inherent therein. The particular examples and configurations disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative examples disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the incarnations of the present inventions. At the very least, and not as an attempt to limit the application of the doctrine of equivalents to the scope of the claim, each numerical parameter should at least be construed in light of the number of reported significant digits and by applying ordinary rounding techniques.

One or more illustrative incarnations incorporating one or more invention elements are presented herein. Not all features of a physical implementation are described or shown in this application for the sake of clarity. It is understood that in the development of a physical embodiment incorporating one or more elements of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill in the art and having benefit of this disclosure.

While compositions and methods are described herein in terms of "comprising" various components or steps, the compositions and methods can also "consist essentially of" or "consist of" the various components and steps.

What is claimed is:

1. A lubricant composition for use as an engine oil, comprising:

from about 25.0 mass % to about 99.8 mass % of an oil base stock, based on a total mass of the lubricant composition, the oil base stock comprising at least one bio-sourced basestock and at least one alkyl naphthalene;

wherein the at least one bio-sourced basestock comprises squalane; and wherein the lubricant composition comprises about 0.05 mass % or less phosphorus, about 0.05 mass % or less sulfur, and about 0.5 mass % or less ash.

2. The lubricant composition of claim 1, wherein the lubricant composition further comprises from about 0.05 mass % to about 1.0 mass % of at least one metal detergent, based on the total mass of the lubricant composition.

3. The lubricant composition of claim 1, wherein the lubricant composition further comprises a nonzero amount of at least one metal detergent, and wherein the lubricant composition comprises 0.5 mass % or less of the at least one metal detergent, based on the total mass of the lubricant composition.

4. The lubricant composition of claim 1, wherein the lubricant composition further comprises at least one metal detergent, and wherein the at least one metal detergent comprises an overbased metal detergent, and wherein the overbased metal detergent comprises calcium sulfonate, magnesium sulfonate, calcium phenate, or any combination thereof.

5. The lubricant composition of claim 1, further comprising from about 0.1 mass % to about 1.0 mass % of at least one ashless antiwear additive, based on the total mass of the lubricant composition.

6. The lubricant composition of claim 1, further comprising from about 0.1 mass % to about 10.0 mass % of at least one antioxidant, based on the total mass of the lubricant composition.

7. The lubricant composition of claim 1, further comprising from about 2.0 mass % to about 5.0 mass % of at least one aminic antioxidant, based on the total mass of the lubricant composition.

8. The lubricant composition of claim 6, wherein the at least one aminic antioxidant comprises a p,p'-dioctyldiphenylamine, an octylated phenyl-alpha-naththylamine, or combinations thereof.

9. The lubricant composition of claim 1, wherein the at least one bio-sourced basestock further comprises a polyalphaolefin, an ester, or any combination thereof.

10. The lubricant composition of claim 1, wherein the lubricant composition comprises from about 25.0 mass % to about 80.0 mass % of the at least one bio-sourced basestock, based on the total mass of the lubricant composition.

11. The lubricant composition of claim 1, wherein the lubricant composition comprises from about 10.0 mass % to about 50.0 mass % of the at least one alkyl naphthalene, based on the total mass of the lubricant composition.

12. The lubricant composition of claim 1, wherein the lubricant composition comprises from about 5.0 mass % to about 9.0 mass % of at least one polyol ester, based on the total mass of the lubricant composition.

13. The lubricant composition of claim 1, wherein the lubricant composition comprises from about 5.0 mass % to about 9.0 mass % of at least one mixed pentaerythritol esters of branched alkanoic acids, based on the total mass of the lubricant composition.

14. The lubricant composition of claim 1, wherein the lubricant composition comprises from about 5.0 mass % to about 9.0 mass % of trimethylolpropane 3,5,5-trimethylhexanoate ester, based on the total mass of the lubricant composition.

15. The lubricant composition of claim 1, wherein the lubricant composition has a bio-based carbon content (ASTM D6866-22) of about 25% or greater.

16. The lubricant composition of claim 1, wherein the lubricant composition has a 200% viscosity increase time at 165° C. from about 400 hours to about 1,500 hours, as measured by the Sequence IIIE screener test.

17. The lubricant composition of claim 1, wherein the lubricant composition comprises less than about 0.03 mass % phosphorus, less than about 0.03 mass % sulfur, and less than about 0.03 mass % ash.

18. A lubricant composition for use as an engine oil, comprising:

from about 25.0 mass % to about 99.8 mass % of an oil base stock, based on a total mass of the lubricant composition, the oil base stock comprising at least one bio-sourced basestock and at least one alkyl naphthalene, wherein the lubricant composition comprises from about 25.0 mass % to about 80.0 mass % of the at least one bio-sourced basestock, wherein the at least one bio-sourced basestock comprises squalane, and wherein the lubricant composition comprises about 10.0 mass % to 30.0 mass % of the at least one alkyl naphthalene;

from about 0.0 mass % to about 1.0 mass % of at least one metal detergent, based on the total mass of the lubricant composition;

from about 0.1 mass % to about 1.0 mass % of at least one ashless antiwear additive; and from about 0.1 mass % to about 10.0 mass % of at least one antioxidant;

wherein the lubricant composition comprises about 0.05 mass % or less phosphorus, about 0.05 mass % or less sulfur, and about 0.5 mass % or less ash.

19. A process for making a lubricant composition, comprising:

combining from about 25.0 mass % to about 99.8 mass % of an oil base stock, based on a total mass of the lubricant composition, the oil base stock comprising at least one bio-sourced basestock and at least one alkyl naphthalene, and from about 0.0 mass % to about 1.0 mass % of at least one metal detergent, based on the total mass of the lubricant composition;

wherein the at least one bio-sourced basestock comprises squalane; and wherein the lubricant composition comprises about 0.05 mass % or less phosphorus, about 0.05 mass % or less sulfur, and about 0.5 mass % or less ash.

20. The process of claim 19, wherein the lubricant composition has a bio-based carbon content (ASTM D6866-22) of about 25% or greater.

21. The process of claim 19, wherein the lubricant composition comprises from about 10.0 mass % to about 30.0 mass % of the at least one alkyl naphthalene, based on the total mass of the lubricant composition.

22. The process of claim 19, wherein the lubricant composition comprises about 0.03 mass % or less phosphorus, about 0.03 mass % or less sulfur, and about 0.03 mass % or less ash.

23. The process of claim 19, wherein the lubricant composition comprises about 50 mass % to about 70 mass % squalane and about 10 mass % to about 30 mass % of the at least one alkylated naphthalene, each mass percentage based on the total mass of the lubricant composition.

* * * * *